US006496154B2

(12) United States Patent
Gyenes

(10) Patent No.: US 6,496,154 B2
(45) Date of Patent: Dec. 17, 2002

(54) FREQUENCY ADJUSTABLE MOBILE ANTENNA AND METHOD OF MAKING

(76) Inventor: Charles M. Gyenes, 21085 Cielo Vista Way, Wildomar, CA (US) 92595-8524

( * ) Notice: Subject to any disclaimer, the term of this patent is extended or adjusted under 35 U.S.C. 154(b) by 0 days.

(21) Appl. No.: 09/927,950

(22) Filed: Aug. 10, 2001

(65) Prior Publication Data

US 2002/0036594 A1 Mar. 28, 2002

Related U.S. Application Data

(63) Continuation-in-part of application No. 09/480,615, filed on Jan. 10, 2000, now Pat. No. 6,275,195.

(51) Int. Cl.[7] ..... H01Q 9/00
(52) U.S. Cl. ..... 343/745; 343/750; 343/713
(58) Field of Search ..... 343/745, 750, 343/860, 861, 846, 713, 749, 900, 715

(56) References Cited

U.S. PATENT DOCUMENTS 3,541,554 A * 11/1970 Shirey ..... 343/713
3,798,654 A * 3/1974 Martino et al. ..... 343/745
4,080,604 A * 3/1978 Wosniewski ..... 343/745
4,117,493 A * 9/1978 Altmayer ..... 343/715
4,584,587 A * 4/1986 Ireland ..... 343/745
4,958,163 A * 9/1990 Leonard ..... 343/745
5,883,600 A * 3/1999 Kukura ..... 343/745
6,275,195 B1 * 8/2001 Gyenes ..... 343/745

* cited by examiner

*Primary Examiner*—Don Wong
*Assistant Examiner*—Shih-Chao Chen
(74) *Attorney, Agent, or Firm*—William L. Chapin

(57) ABSTRACT

A frequency adjustable radio antenna includes a conductive whip on an insulated cylindrical coil housing electrically connected to the upper end of a tuning coil within the housing. A commutator attached to a conductive shaft is raised/lowered to interpose less/more coil turns between shaft and whip to tune the antenna. An RF de-coupler slidably contacts the shaft, and electrically contacts the lower end of the coil and a conductive mast which supports the housing, thus shorting out lower portions of the coil to suppress harmonic currents from being induced therein. A method for making the coil includes winding wire onto a mandrel in a first direction, sliding a housing over the windings, and rotating the mandrel in an opposite direction to cause coil convolutions in a helical mandrel groove to increase in diameter and thereby spring out of the mandrel groove and into a helical coil housing groove.

23 Claims, 14 Drawing Sheets

163
164
159
162
101
160
170
169
108
171
105
106
107
100
116
104
103
109
113
115
114
112
102
111
110

FREQUENCY ADJUSTABLE MOBILE ANTENNA AND METHOD OF MAKING

RELATED APPLICATION INFORMATION

This application is a continuation-in-part of application Ser. No. 09/480,615, filed Jan. 10, 2000, now U.S. Pat. No. 6,275,195, issued Aug. 14, 2001.

BACKGROUND OF THE INVENTION

A. Field of the Invention

This invention relates to a radio transceiver antenna which is tunable to a range of radio frequencies. Radio transceivers are quite sensitive to antenna performance, requiring that the antenna have a sufficiently low Voltage Standing Wave Ratio (VSWR) and sufficiently high power handling capacity to efficiently radiate transmitter power output under varying environmental conditions. Such antennas are employed universally by Maritime, Aviation, Military and Government services, and by the general public as well, and it is the use of mobile transceivers and antennas which is the focal point of this invention.

It is the High Frequency (HF) range of radio transmission with which this invention is particularly concerned, although it is to be understood that the tuning concepts herein disclosed are equally applicable to other radio frequency bands as may be required. With respect to the HF range covering 1.6 to 30 $MH_z$ frequencies, the size, and particularly the length of the antenna is frequently a limiting factor on mobile transceiver performance. Assuming that a transceiver is installed on and transported by a moving vehicle, clearance along most highways and roadways is 14 feet, whereas the optimum vertical height of a properly tuned antenna can far exceed said highway or roadway clearance. Therefore, it is an object of this invention to increase and decrease the tuned, electrical antenna length (as distinguished from physical height), thereby avoiding limitations imposed by highway and/or roadway vertical clearance.

B. Description of Background Art

Heretofore, some RF antennas have been tuned by means of inserting coils into an antenna circuit that extend the antenna's effective length without extending the height thereof. In practice, individual coils have been employed and installed for each radio frequency to be matched. Or, complicated and expensive Antenna Tuners have been used, but they are bulky extra equipment.

OBJECTS OF THE INVENTION

It is therefore a general object of this invention to provide an antenna which can be fine tuned to any radio frequency within a specified range, and in particular for example in this disclosure, the practical High Frequency HF range from 3.5 to 30 $MH_z$ In practice, the antenna is center loaded with a coil and a longitudinally movable commutator that adjustably extends the effective length of the antenna.

It is another object of the present invention to provide an antenna which includes an actuator mechanism that is energizable by a remote switch, by which means the antenna can be adjustably tuned from a transceiver located at some distance from the antenna.

Another object of the invention is to provide matching impedance of the antenna by means of a shunt to ground, as will be described.

Another object of the invention is to provide a frequency adjustable mobile antenna which includes a first disk-shaped commutator having a circumferential surface for longitudinally movable commutation with convolutions of an upper portion of a coil, the electrical length of which upper coil portion determines the resonant frequency of the antenna.

Another object of the invention is to provide a frequency adjustable antenna having in addition to a first disk-shaped commutator for longitudinally movable tunable commutation with the upper portion of a coil, a second, lower disk-shaped contactor for resiliently and electrically conductively contacting a coaxially located shaft longitudinally slidable within the lower contactor, the contactor being in electrical contact with the lower end of the coil winding and the upper end of the shaft being in electrical contact with the disk-shaped commutator, whereby the lower portion of the coil is electrically shorted or "RF de-coupled," thereby suppressing any harmonic currents which might otherwise be generated in the lower portion of the coil by auto transformer action.

Another object of the invention is to provide a method of making a coil assembly for a frequency adjustable antenna which includes the steps of winding a coil on a helically grooved mandrel, inserting the coil and mandrel into coil housing having formed in an inner cylindrical wall surface thereof a helical groove, expanding the diameter of the coil to thereby release it from the mandrel grooves and loosely seat the coil convolutions into the convolutions of the helical groove within the coil housing, removing the coil housing from the mandrel, and further expanding the diameter of the coil to rigidly fix the coil within the coil housing groove.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated the present invention includes a frequency adjustable antenna for use with radio transceivers, particularly those used in vehicles. One embodiment of the invention includes a lower, electrically conductive hollow tubular mast section electrically isolated from a mounting bracket and having a radio frequency connection to a transceiver, and an upper electrically conductive extensible mast section insulated electrically from the lower mast section and adapted to hold an elongated whip antenna. The upper and lower mast sections are fastened in coaxial alignment therewith to the upper and lower ends of a hollow cylindrical coil housing, which is made of an electrically nonconductive material and has formed in the inner cylindrical wall surface thereof an elongated helical groove. The groove holds conformally therewithin convolutions of an electrically conductive tuning coil, the lower end of which is in electrical contact with the lower mast section. A disk-shaped contactor means or commutator fits coaxially within the coil, the commutator having a circumferential spring member which has a resilient outer circumferential surface which is in electrically conductive, longitudinally slidable contact with inner circumferential surfaces of convolutions of the tuning coil, the contactor being carried by and in electrical contact with the upper mast section. An electric motor and lead screw mechanism within a hollow interior space of the lower mast section of the antenna raises and lowers the upper extensible mast section and the commutator in response to external command signals, thus interposing more or less coil convolutions in series between the lower end of the upper mast and the lower mast, thus resonating the antenna to lower or higher frequencies, respectively.

In another embodiment of an antenna according to the present invention, the conductive whip at the upper end of the antenna is fixed in a cap attached to the upper end of an insulated coil housing and is electrically connected to the upper end of a tuning coil within the housing, and remains stationary. In this embodiment, a commutator disk at the upper end of a conductive shaft is raised or lowered to interpose less or more turns between the lower end of the shaft and the whip to tune the antenna. This embodiment also includes an RF de-coupler which has an annular ring-shaped spring member that has a resilient inner circumferential surface in longitudinally slidable contact with the outer surface of the conductive shaft, and an outer surface in electrically conductive contact with the lower end lead of the coil and a lower conductive mast, thus shorting out the lower portion of the coil and thereby suppressing harmonics or subharmonic currents from being induced therein.

According to a method of making a coil assembly of the type described above for the frequency adjustable mobile antenna, wire is wound into a helical groove formed in a mandrel of smaller diameter than the inner diameter of an elongated cylindrical coil housing having formed in an inner cylindrical wall surface thereof a helical housing groove, by rotating the mandrel in a first direction, a coil housing is slipped over the wound coil on the mandrel, the mandrel is turned in an opposite direction to cause coil convolutions in the mandrel groove to increase in diameter and thereby spring out of the helical mandrel groove and into the helical coil housing groove, and wire from a supply reel is severed, whereupon the coil and housing are removed from the mandrel, and a resilient paddle forcibly inserted sequentially into opposite longitudinal ends of the coil bore and turned to further increase the diameter of the coil helix and thereby securely seat the coil within the coil housing.

DESCRIPTION OF THE PREFERRED EMBODIMENTS

Figure 3:
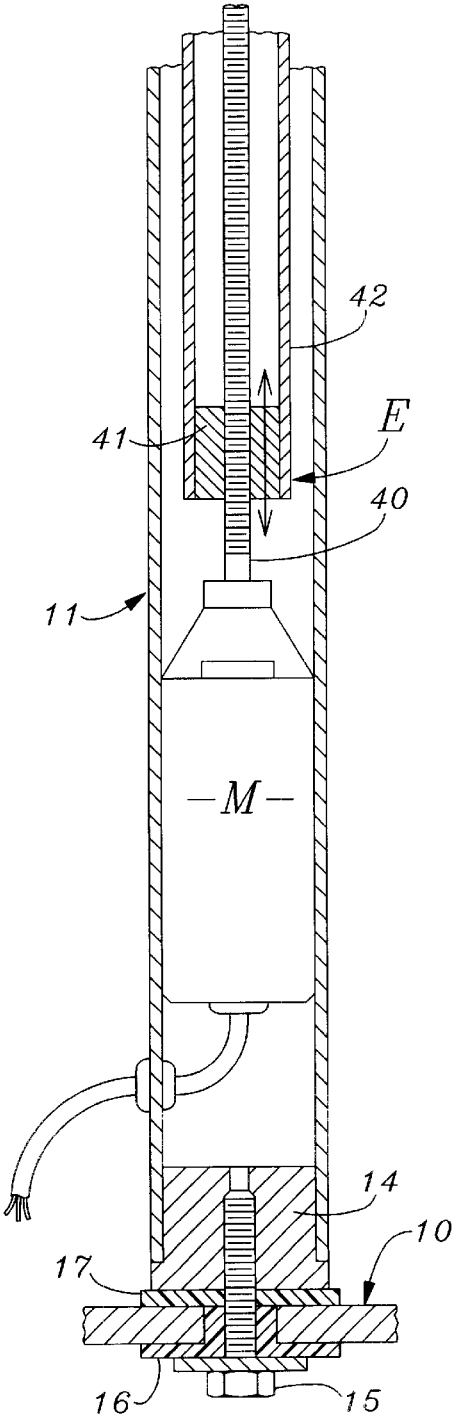
FIG. 3 is a fragmentary vertical longitudinal sectional of a lower portion of the antenna of FIG. 1, showing linear actuator components thereof.
Figure 4:
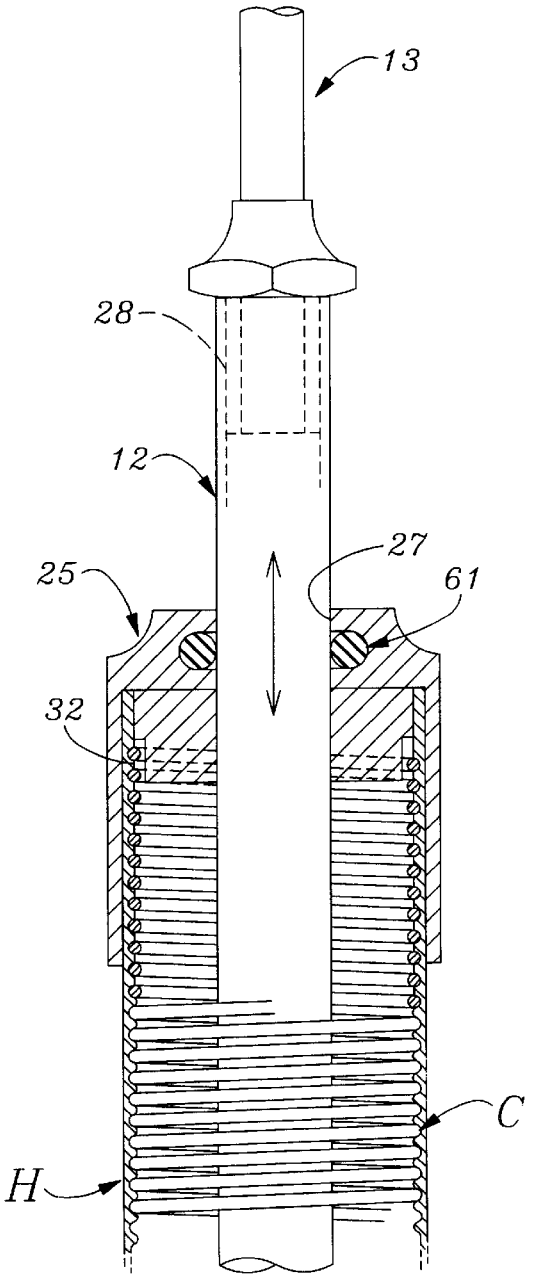
FIG. 4 is a fragmentary vertical longitudinal sectional view of an upper portion of the antenna of FIG. 1.
Figure 5:
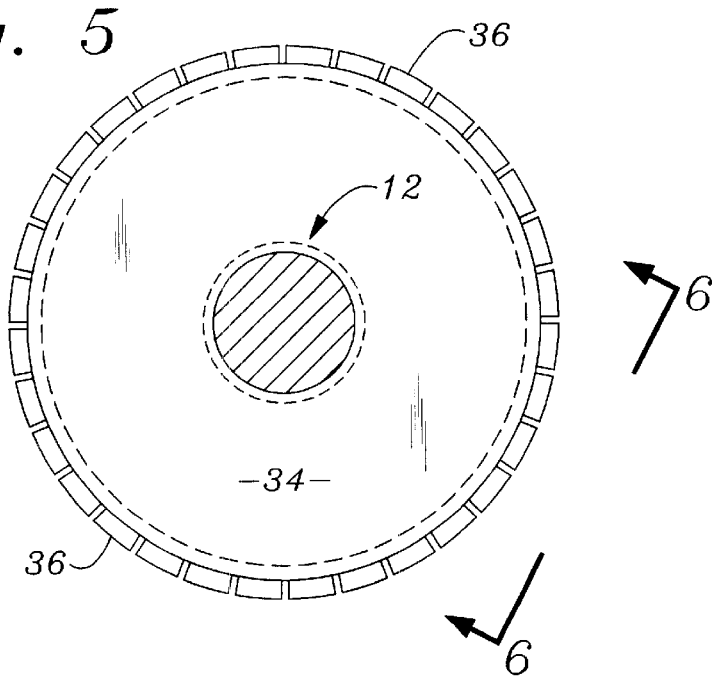
FIG. 5 is an enlarged transverse cross sectional view taken along line 5—5 of FIG. 2, and showing a preferred resilient commutator means.
Figure 6:
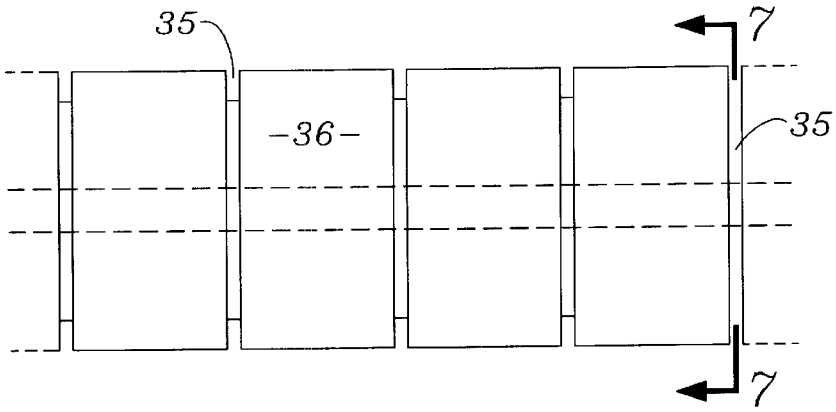
FIG. 6 is a further enlarged lineal section of the resilient commutator means of FIG. 5, taken along line 6—6.

Referring now FIGS. 1–6, a mobile antenna 9 according to the present invention is vertically disposed when installed for use on a vehicle or the like using bracket 10, and is comprised generally of a sectional mast having a lower mounted section 11 and an upper extensible section 12 to which a replaceable whip section 13 is attached. These three sections are electrically conductive and separated by tubular insulating polycarbonate coil housing H that positions a center loading coil C intermediate the mast sections 11 and 12 and coaxially guides said sections, there being an adjustable contactor or commutator K carried by the upper mast section 12 for commutation with said loading coil C and positioned by elevator means E (FIG. 3). The electrically conductive elements of the antenna are the lower mast sections 11, upper mast section 12 and whip 13, the coil C and the commutator K, all other elements being non-conductive and/or isolated electrically from the conductive antenna elements.

Referring to FIG. 3, lower mast section 11 is the mounted portion of the antenna and is secured to a horizontal plate of the bracket 10 by means of a base 14 secured into the tubular section 11 and fastened to bracket 10 as by a cap screw 15 extending through insulating bushing 16 and washer 17 as shown in FIG. 3. Accordingly, lower mast section 11 is electrically isolated to receive radio frequency RF power from a coaxial cable 18 grounded at 19 with a single power conductor 20 connected to the lower mast section 11 at 21. In practice, lower mast section 11 is approximately 2 inches in diameter and its height can vary from 2 to 5 feet, the preferred mast section 11 being 3 feet from top to bottom. The top of the tubular mast section 11 is closed by a cap 22 of conductive material secured thereto and having a concentric guide opening 23, and coil housing H and coil C mounting features.

Referring to the electrically insulated coil housing H, a feature which characterizes this invention, in its simplified and preferred form is a cylinder of dielectric material, preferably a clear polycarbonate seated concentrically in the aforementioned mounting feature of the cap 22 and positioned against a shoulder 24 to extend vertically from the conductive cap 22 and from the conductive top terminal end of lower mast section 11. In practice, the housing is approximately 3 inches in diameter and 9 inches high, closed at its bottom by cap 22. The top of the cylindrical housing is closed by a non-conductive cap 25 secured thereto against a shoulder 26 and having a concentric guide opening 27.

Referring to the upper mast section 12, this is the adjusted end of the antenna that selectively extends its physical height approximately 8 inches while increasing the adjusted tuned frequency length of the antenna to approximately 66 feet at 3.8 $MH_z$ from its original 13 ½foot height. Upper mast section 12 is slidably received by and reciprocates through the guide opening 27 of the insulating cap 25. Upper mast section 12 is a tubular member of electrically conductive material approximately one (1) inch in diameter and preferably 12 inches high closed by a top plug 28, threaded to detachably receive the whip section 13 of a length to reach the aforesaid physical antenna height of 13½feet.

In accordance with this invention the center loading coil C is protectively imbedded in threaded grooves positioned within the cylindrical housing H and characterized by helically separated convolutions of uniform pitch diameter, anchored at top and bottom ends by the housing H and exposed internally to the commutator K as will be described. In practice, the pitch diameter of the coil C is 2.75 inches and coincidental with the inner diameter of the housing H, in which case each convolution thereof represents 8.639 lineal inches, there being 72 turns of coil in 8 inches, utilized for tuning between 3.5 and 30 $MH_Z$ the coil C having a pitch of 9 turns per inch. Accordingly, the lineal tuning capacity is 72 turns of coil resulting in a total lineal extension capacity of 622 inches or 51.834 feet. Therefore, the complete assembly having a total mast-whip height of 13½feet can be fine tuned to 3.5 MHz when the contact disc 34 later described is extended to the top of said active 8 inches of useful coil C. Whereas, said complete assembly can be retracted 8 inches and fine tuned to 3.0 $MH_z$ at the top of said active 8 inches of useful coil C.

In practice, the height of the whip section 13 may be reduced so as to restrict the antenna height to said 13½feet (practical maximum) above the road pavement level, the base of lower mast section 11 being mounted at vehicle bumper level approximately 12 to 18 inches above the road pavement level. This variation in antenna base height is inherently compensated for when tuning the coil C with commutator K, restricting top end tuning but slightly.

There is a performance radiation efficiency improvement that results in a feed-point impedance, in this instance of 52 Ohms, which is balanced by a 52 Ohm shunt 60 to ground at the base of lower mast section 11 connected to the grounded mounting bracket 10.

Figure 7:
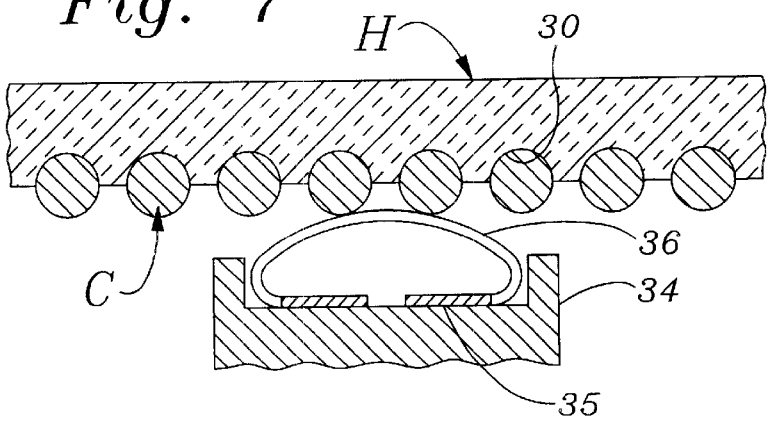
FIG. 7 is a longitudinal cross sectional view of the resilient commutator means of FIG. 7, taken along line 7—7 and showing the commutator means in axially adjustable electrically conductive contact with turns of the loading coil of FIGS. 2 and 4.

As shown best in FIG. 7, the inner diameter of the cylindrical housing H is threadedly grooved at 30 to match the semi-circular outer cross section of the coil wire which is formed of #12 or #14 gauge hard drawn copper that is silver plated for conductivity, the pitch diameter of the semi-circular groove being coincidental with the inner diameter of the housing H. Alternatively, the coil wire may be enameled copper, the inner cylindrical surface of which is honed to remove the enamel coating. The mounting feature in caps 22 and 25 includes shouldered seats 31 and 32 firmly receiving and positioning the inner diameter of coil C at the top and bottom ends of the housing H. Note that the bottom end of coil C is electrically connected through the conductive cap 22 to the lower mast section 11, and that the top end of the coil C is insulated electrically from the conductive upper mast section 12.

Referring now to the commutator K carried by the upper mast section 12, the number of coil turns made active between the lower and upper mast sections is determined by the height or elevated position of a contactor disc 34 within the coil C. In its simplified and preferred form, the commutator K is a peripheral series of radially yieldable contacts 36 carried coaxially with the mast sections 11 and 12 by the electrically conductive contactor disc 34 with the lower conductive end of the upper mast section 12. In practice, a circumferential spring strip of resilient beryllium copper comprised of spaced supporting band members 35 with a multiplicity of next adjacent radially arched tabs 36 in a circumferential series extending between bands 35 and bearing outwardly for presenting radially disposed, arcuately convexly curved contact faces. The bands 35 and integral arched tabs 36 are captured within axially spaced peripheral flanges of the contactor disc 34, see FIG. 7. The tabs 36 are individually depressible radially inward, whereby the series of circumferentially adjacent contact surfaces thereof engageably embrace a substantial sector of any one coil convolution when axially positioned between the top and bottom of the coil C, thereby determining the adjusted effective tuned length of the antenna.

Referring to the elevator means E, a reversible gear-head servo motor M is housed within the lower portion of the tubular mast section 11, from which an elevator screw 40 extends upward and coaxially to threadedly engage a nut 41 carried at the lower end of an extension tube 12 of insulating material slidably passing through the guide opening 23 in cap 22 and affixed to the contactor disc 34 (see FIG. 3) to raise and lower the same. Note that the lower mast section 11 is frictionally engaged through the guide opening 23 in cap 22, that the upper section 12 is frictionally engaged through the guide opening 26 in cap 25, and at the contactor disc 34 contact tabs 36 are frictionally engaged within the coil C, there being an "O" ring weather seal 61, all of which frictionally prevents turning of the elevator means nut 41, whereby the elevator screw 40 of small diameter, compared with the aforesaid frictional engagements, revolves freely within the nut 41 to raise and lower the contactor disc 34.

FIGS. 8–17 illustrate another embodiment of a frequency adjustable mobile antenna according to the present invention.

Figure 8:
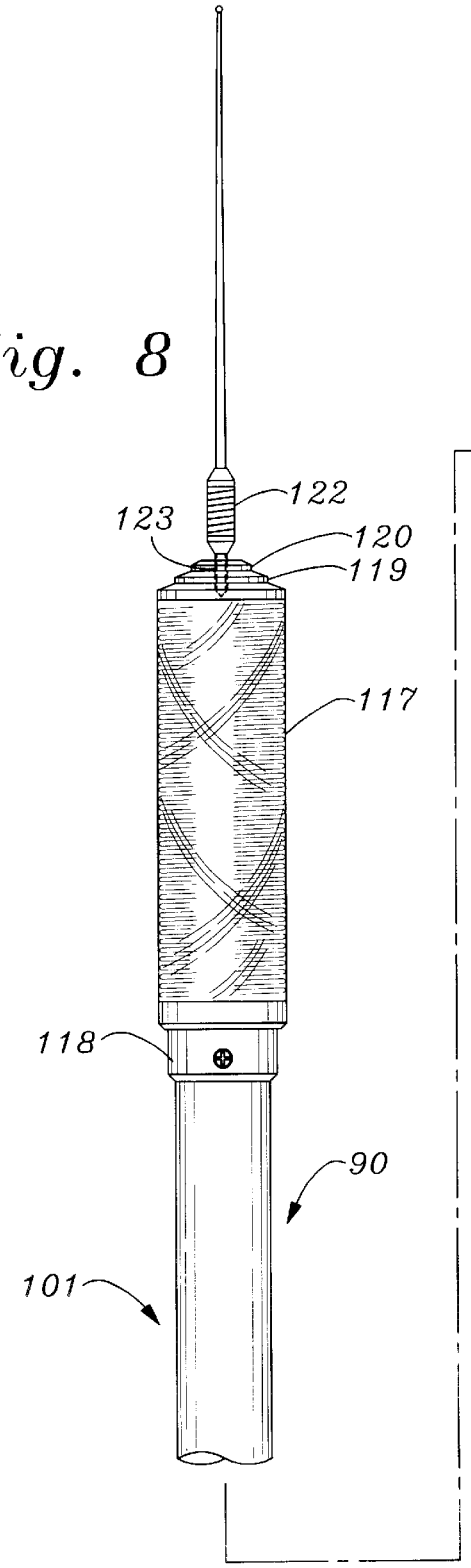
FIG. 8 is a front elevation view of an upper portion of another embodiment of a frequency adjustable mobile antenna according to the present invention, in which the upper mast thereof is fixed with respect to the lower mast.
Figure 9:
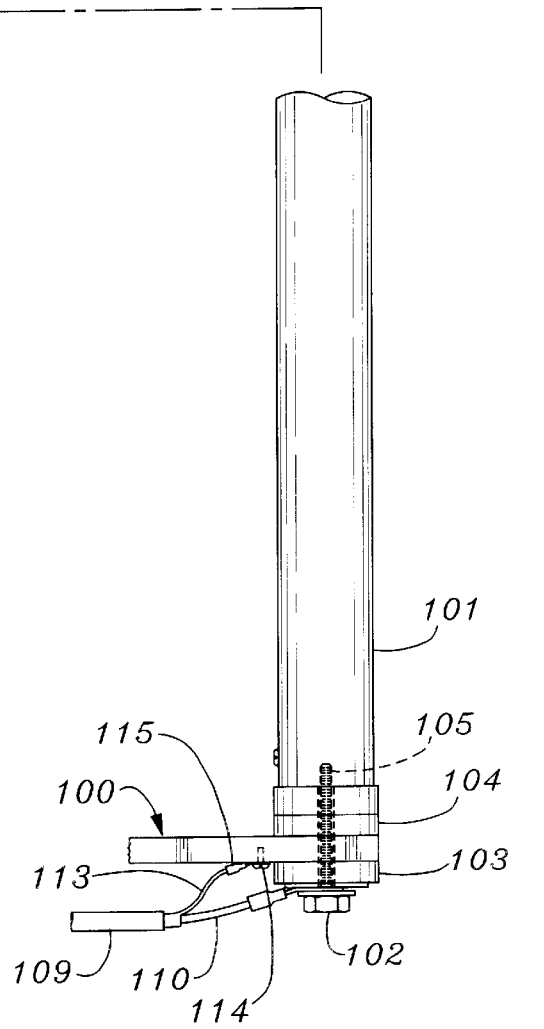
FIG. 9 is a front elevation view of a lower portion of the embodiment shown in FIG. 8.
Figure 12:
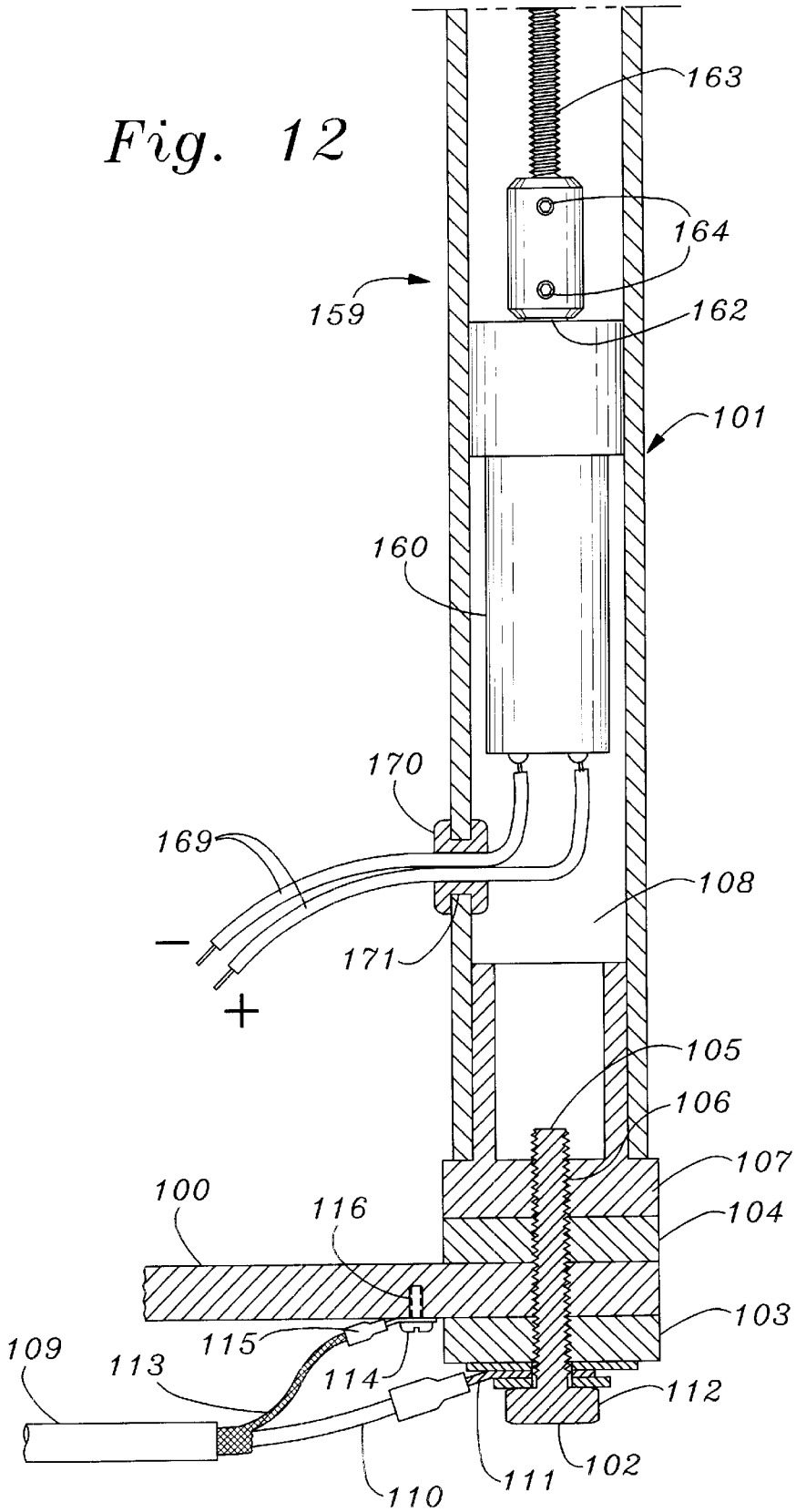
FIG. 12 is a fragmentary vertical longitudinal sectional view of a lower portion of the antenna of FIGS. 8 and 9.

Referring first to FIGS. 8 and 9, a frequency adjustable mobile antenna 90 according to the present invention may be seen to include a lower bracket 100 for mounting the 12 antenna to a bumper or other structural component of a vehicle, and a tubular electrically conductive mast section 101 which is mounted to the bracket and protrudes perpendicularly upwards therefrom. Mast 101 is secured in electrically non-conductive to bracket 100 by means of a conductive bolt 102 which is inserted through the bores of lower and upper insulating washers 103, 104 on opposite sides of the bracket, the bolt passing through a bore through the bracket which is coaxially aligned with the washer bores. The upper end portion of shank 105 of bolt 101 is threadingly received and tightened into a threaded bore 106 centered in a metal base plug 107 which is secured coaxially within the bore 108 of mast section 101. (FIG. 12)

As shown in FIG. 9, mast section 101 of antenna 90 is connected to a radio transceiver (not shown) by a coaxial cable 109 which has a central conductor 110, terminated by an eyelet 111 that receives shank 105 of bolt 102 and is secured between lower washer 103 and bolt head 112 in electrically conductive contact with the bolt head. Coaxial cable 109 also has an outer electrically grounded shield braid lead 113 which is secured in electrically conductive contact to conductive metal mounting bracket 100 by means of a screw 114 which is inserted through an eyelet 115 and tightened into a threaded bore in the bracket.

As shown in FIG. 8, antenna 90 includes an elongated tubular coil housing 117 made of an electrically insulating material such as polycarbonate plastic which is mounted at the upper end of tubular most section 101, in coaxial alignment therewith, by means of a metal base plug 118 which fits coaxially with the coil housing and coaxially over the upper end of the mast section. Antenna 90 also includes a conductive metal cap 119 which fits coaxially on top of coil housing 117. Cap 119 is provided with a threaded blind coaxial bore 120 which protrudes downwards from upper surface 121 of the cap, to threadingly receive in electrically conductive contact therewith the lower threaded end 123 of a conductive antenna whip 122. (FIG. 10A)

Figure 10A:
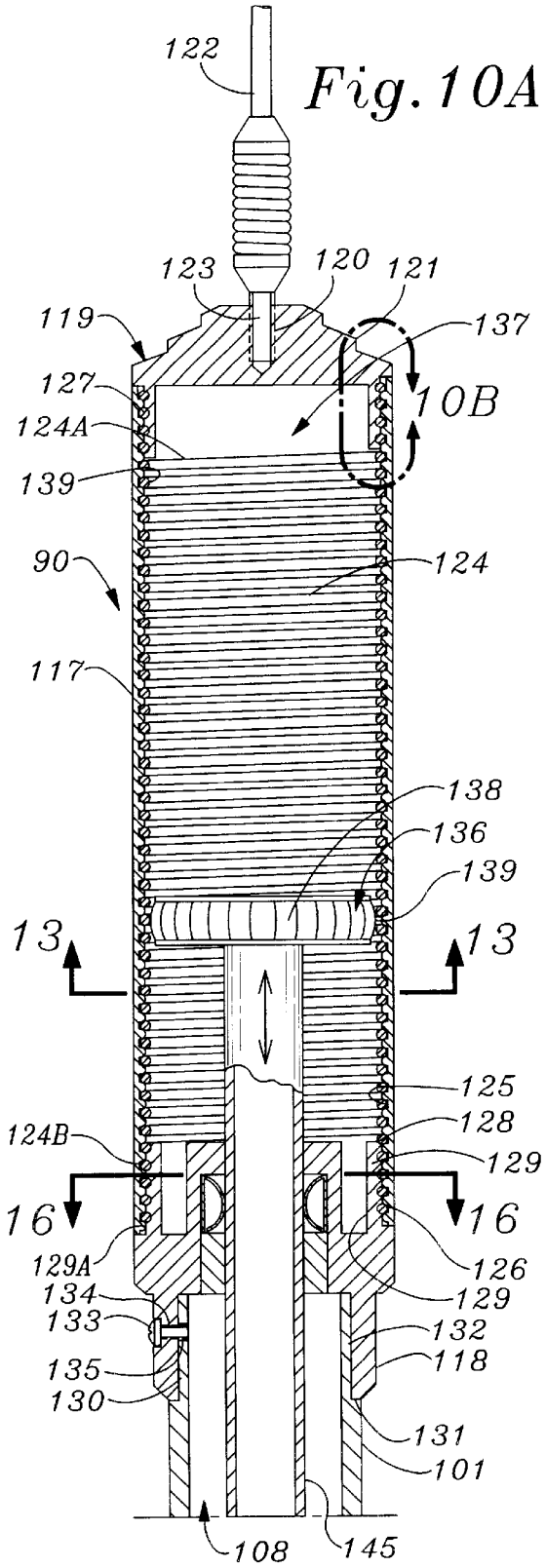
FIG. 10A is a fragmentary vertical longitudinal sectional view of an upper portion of the antenna of FIG. 8 on an enlarged scale and showing an axially translatable upper tuning commutator in electrically conductive contact with a tuning rail thereof, and a lower RF de-coupler contactor fixed with respect to a lower end portion of the coil and electrically conductively coupled to the lower end of the coil and a carrier tube axially translatable within the de-coupler contactor, the upper end of the carrier tube being in electrically conductive contact with the upper tuning contactor.
Figure 10B:
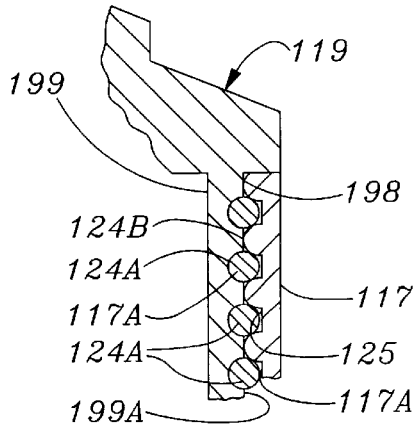
FIG. 10B is a fragmentary view of the antenna of FIG. 10A on an enlarged scale.

Referring now to FIGS. 10A and 10B, it may be seen that antenna 90 includes a longitudinally elongated solenoidal electrical coil 124 which fits conformally within a longitudinally elongated helical groove 125 formed in the inner wall surface 117A of coil housing 117. Coil 124 has a lower end portion 126 which is in electrically conductive contact with metal base plug 118 at the lower end of coil housing 117 of antenna 90, and an upper end portion 127 which is in electrically conductive contact with cap 119 of the upper end of the coil housing. Base plug 118 is secured to coil housing 117 in electrical contact with a plurality of lower convolutions 124A of coil 124, and cap 119 is secured to the housing in contact with a plurality of upper coil convolutions 124B in a novel manner which may be best understood by referring to FIG. 10B. As shown in FIG. 10B, metal cap 119 is preferably secured to coil housing 117 by means of external helical threads 198 in the outer cylindrical surface 199A of lower reduced diameter portion 199 of cap 119, the threads 198 being threadingly received within a helical groove 124B formed between coil convolutions 124A protruding radially inward of inner cylindrical wall surface 117A in coil housing 117. Similarly, base 118 is provided with external helical threads 128 in the outer cylindrical surface 129A of a reduced diameter upper portion 129 of the base, the threads being threadingly received within a lower end portion of helical groove 124B formed between coil convolutions 124A. Base 118 is provided with a coaxial bore 130 which protrudes inwardly from lower face 131 of the base, the bore receiving in a relatively tight fit an upper reduced diameter end portion 132 of mast 101. Mast 101 is secured to base 118 by means of radially disposed screws 133 which are inserted through bores 134 and tightened into threaded bores 135 in upper end 132 of mast 101.

As shown in FIG. 10A, antenna 90 includes a circular disk-shaped commutator 136 which fits coaxially within bore 137 of coil 124 and which has an outer circumferential surface 138 which resiliently and longitudinally slidably contacts inner circumferential surfaces 139 of coil convolutions 124A. Commutator 138 is structurally and functionally identical to commutator disk 34 described above and shown in FIGS. 5–7.

Figure 13:
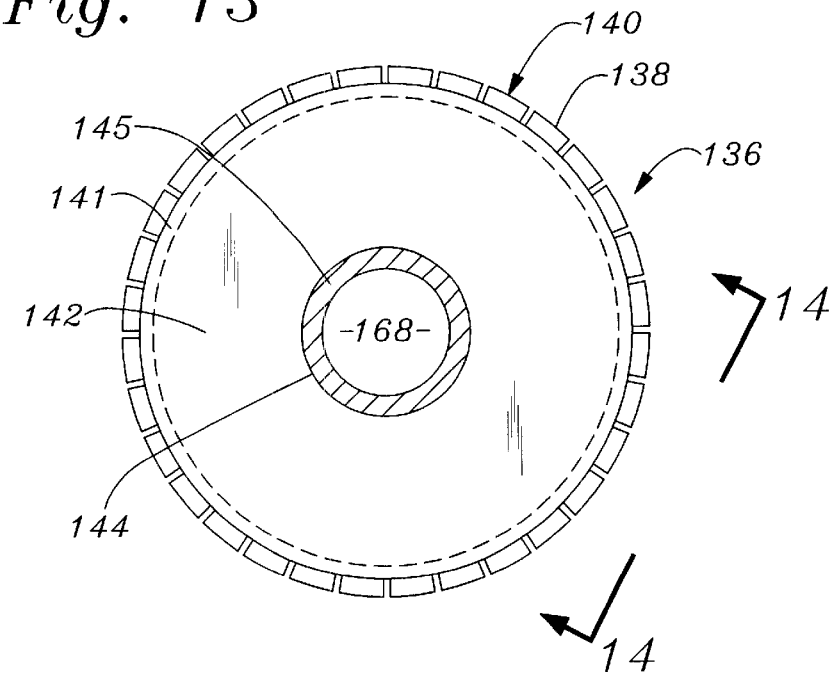
FIG. 13 is a transverse sectional view of the antenna of FIG. 10, taken along line 13—13.
Figure 14:
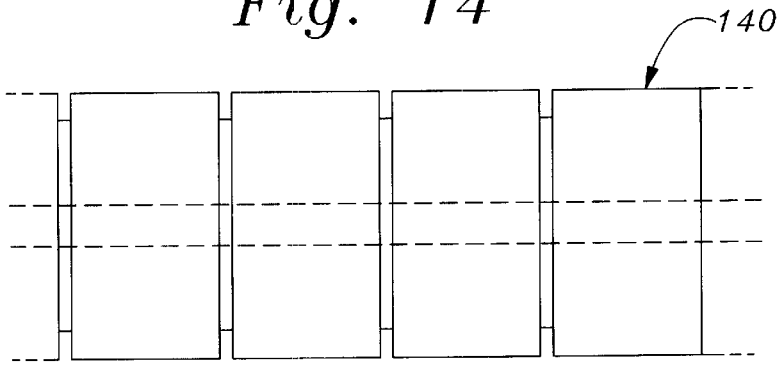
FIG. 14 is an enlarged lineal section of an annular commutator for resiliently contacting coil convolutions which is shown in FIG. 13.
Figure 15:
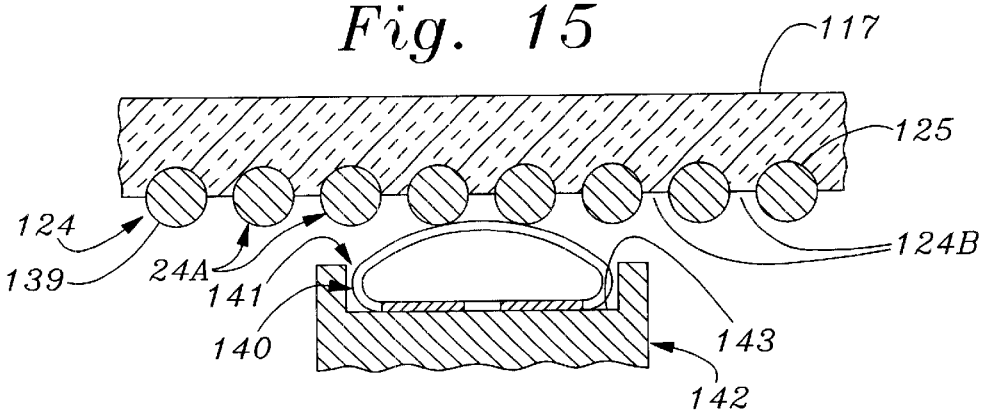
FIG. 15 is a cross section taken as indicated by line 15—15 in FIG. 14, showing resilient longitudinally slidable conductive contact between an outer convexly curved circumferential surface of the commutator and convolutions of the tuning coil of the antenna.

As shown in FIGS. 10A and 13, commutator 136 includes a circumferential spring strip 140 which fits into an annular ring-shaped channel 141 formed in the outer circumferential surface of an electrically conductive disk 142. Spring strip 140 is in electrical conductive contact with the annular lower wall surface 143 of channel 141.

Figure 1:
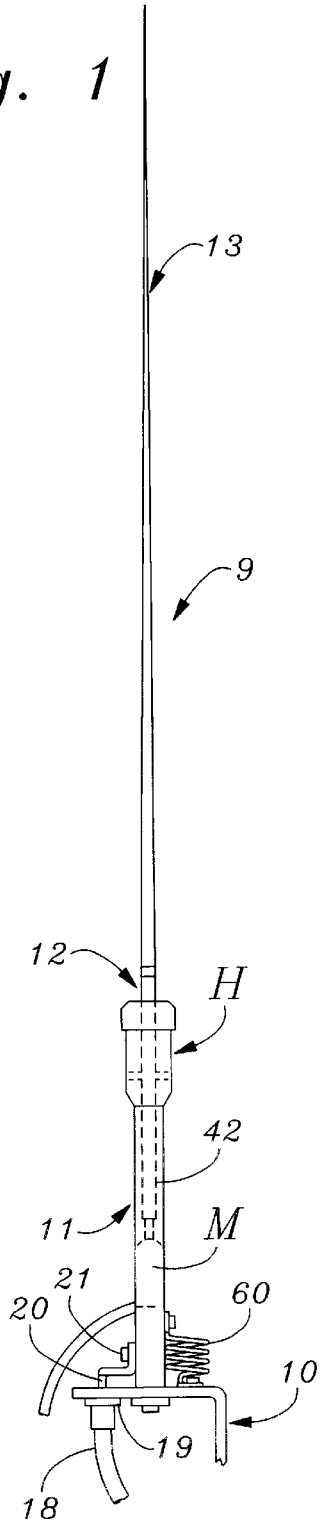
FIG. 1 is a front elevation view of a basic embodiment of a frequency adjustable mobile antenna according to the present invention.
Figure 2:
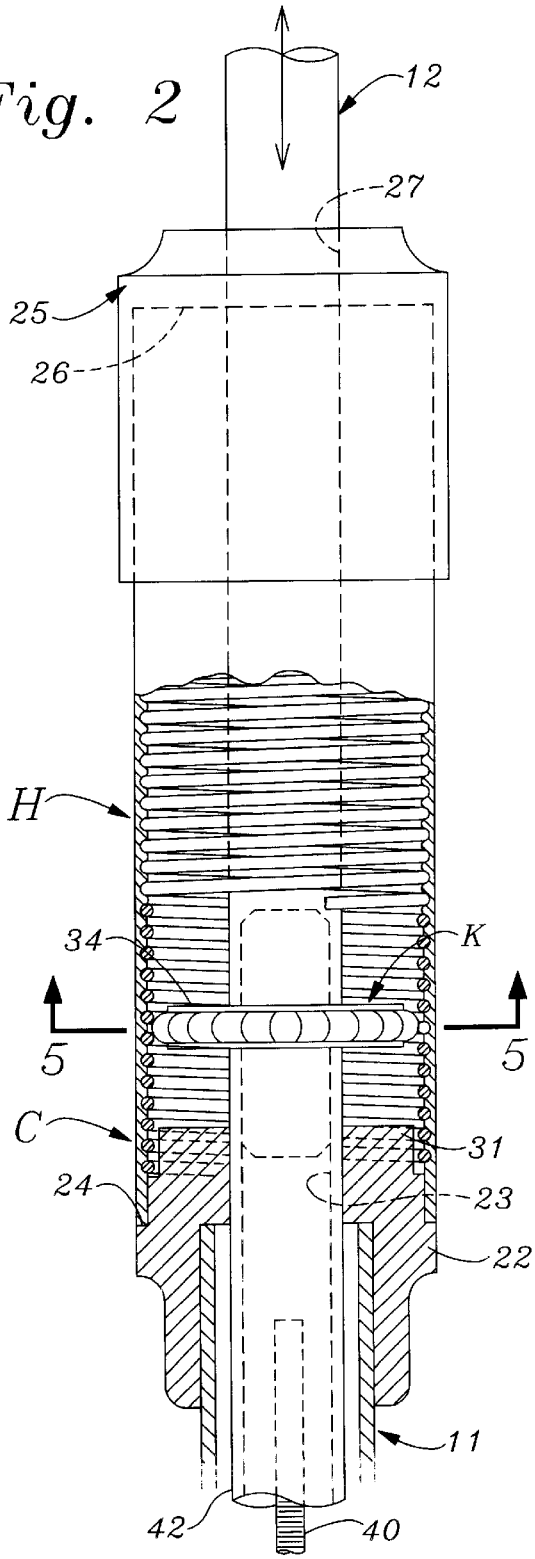
FIG. 2 is a fragmentary elevation view of the antenna of FIG. 1 on an enlarged scale and partly broken away to show a frequency adjustable center loading coil conductively contacted by an axially translatable commutator attached to an axially extensible upper mast, and a lower mast held in fixed relation to the coil.

Referring still to FIGS. 10 and 13, it may be seen that disk 142 of commutator 136 has formed therein a longitudinally disposed, central coaxial bore 144 which receives in a tight, electrically conductive fit the upper end of a longitudinally elongated, cylindrically-shaped conductive shaft 145. As shown in FIGS. 10 and 1, conductive shaft 145 is preferably of hollow tubular construction, and is positioned coaxially within bore 108 of mast 101.

Figure 16:
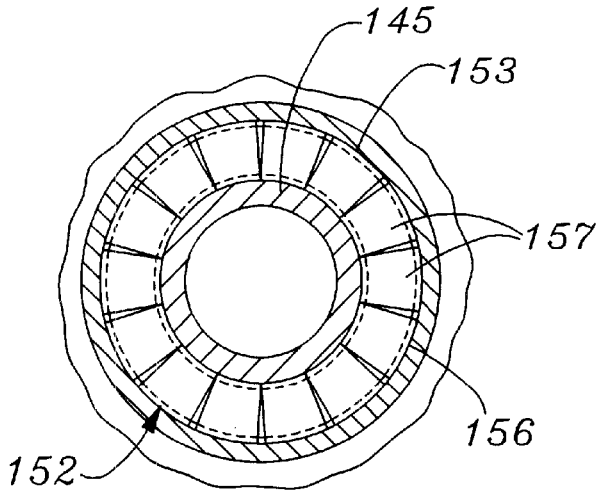
FIG. 16 is another transverse sectional view of the antenna of FIG. 10, taken along line 16—16 and showing an RF de-coupler contactor of the antenna.
Figure 17:
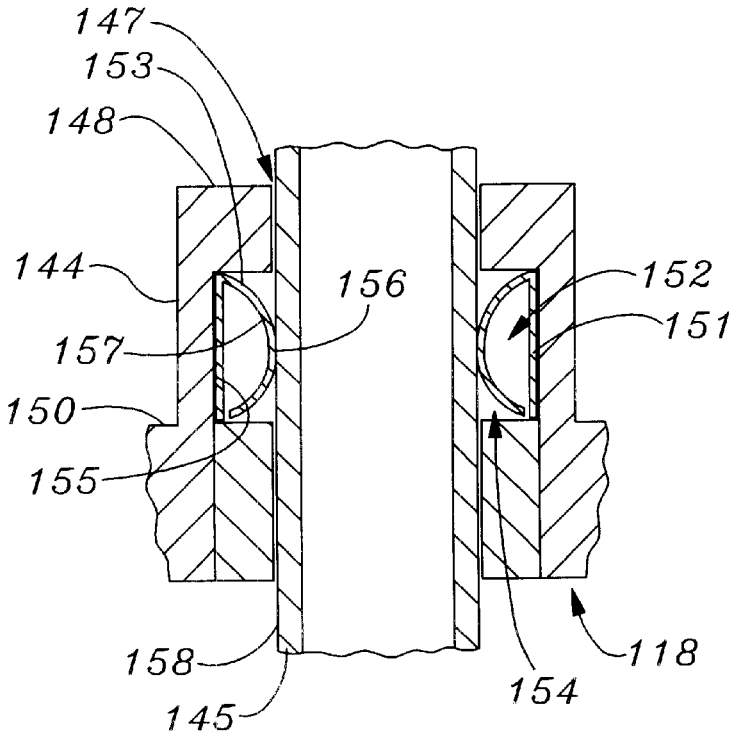
FIG. 17 is a longitudinal sectional view of the RF de-coupler contactor of FIG. 16, showing resilient, longitudinally slidable contact between an inner circumferential surface of the de-coupler and a conductive carrier shaft attached at the upper end thereof to the commutator of FIG. 13.

Referring now to FIG. 17, it may be seen that conductive shaft 145 is longitudinally slidably positioned within a longitudinally disposed bore 147 which coaxially penetrates an upper end wail 148 of a central boss section 144 formed in a web 150 within an upper end 151 of base 118. Bore 147 in boss 149 has fitted coaxially therewithin a ring-shaped resilient RF de-coupler, contactor 152. Contactor 152 is formed of a resilient spring strip 153 of the same construction as spring strip 140 of commutator 136, and fits within an annular channel 154 formed in the inner wall surface 155 of base boss section 149. However, as shown in FIGS. 10A, 16, and 17, spring strip 153 of RF de-coupler contactor 152 is reversed from that of spring strip 140, so that the convex, arcuately curved outer surfaces 156 of the spring segment 157 are on the inner annular surface of the contactor, and thus resiliently contact the outer cylindrical surface 158 of shaft 145 as shown in FIG. 17.

Figure 11:
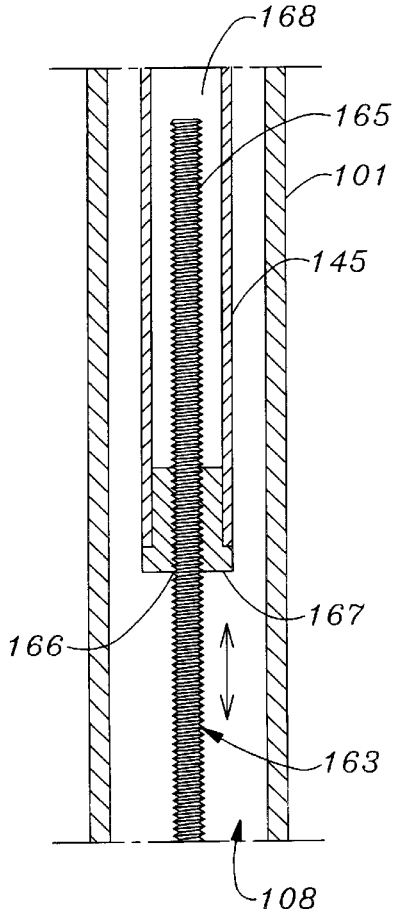
FIG. 11 is a fragmentary vertical longitudinal sectional view of an intermediate longitudinal portion of the antenna of FIGS. 8 and 9, showing linear actuator components thereof.

FIGS. 11 and 12 illustrate the structure and function of components of antenna 90 which comprise a linear actuator mechanism which enables shaft 145 and commutator disk 136 to be raised and lowered within bore 137 of coil 124 to cause the commutator disk to contact selected coil convolutions 124A and thereby tune the antenna to resonate at a selected frequency.

As shown in FIGS. 11 and 12, antenna 90 has a linear actuator mechanism 159 which includes a gear head servo motor 160 mounted coaxially within bore 108 of mast 101. Motor 160 has a rotary output shaft (not shown) which is coupled by means of an insulated plastic coupler 162 to an axially aligned, elongated lead screw 163, as for example by set screws 164. Upper end portion 165 of lead screw 163 is threadingly received within a threaded bore 166 disposed longitudinally through the center of a plug 167 secured in the lower entrance opening of a bore 168 through conductive shaft 145.

As shown in FIG. 12, motor 160 has a pair of input lead wires 169 which protrude through a strain relief grommet 170 fitted in a hole 171 disposed radially through a lower portion of hollow cylindrical mast 101.

Motor leads 169 are connectable to a reversible polarity d.c. voltage source controlled by a reversible switch or servo amplifier, to thereby selectably rotate motor shaft coupler 162 and lead screw 163 in a first sense to elevate shaft 145 and commutator disk 136, and in an opposite sense to lower the shaft and disk. With this arrangement, a series circuit of varying length is formed including the following elements: central coaxial conductor 110, eyelet 111, bolt head I1 2, bolt shank 105, base plug 107, mast 101, coil base plug 118, RF de-coupler contactor 152, conductive shaft 145, commutator disk 136, selected coil convolutions 124A contacted by commutator disk 136, upper coil lead end 127, cap 119 and antenna whip 122. The resonant frequency of this circuit is turnable to a desired frequency for optimum efficiency in transmitting and receiving radio frequency signals by remotely adjusting commutator disk 136 to interpose a selected number of convolutions 124A of coil 124 between the commutator disk and cap 119. It is important to note that coil convolutions 124A below commutator disk 136 are electrical shorted through a series circuit path consisting of the commutator disk, shaft 145 downward to RF de-coupler contactor 145, coil base plug 118, and lower coil end lead 126. Shorting out the lower, variable length portion of coil 124 prevents the production of efficiency-degrading harmonics or sub-harmonics of a selected transmission or reception frequency, which might otherwise be induced in the lower portion of coil 124 by auto transformer action resulting from the mutual inductance between the upper, active convolutions 124A of coil 124 and the lower unused convolutions of the coil.

FIGS. 18–26 illustrate a method of manufacturing a tuning coil assembly C including a coil housing 117 and coil 124 according to the present invention.

Figure 18:
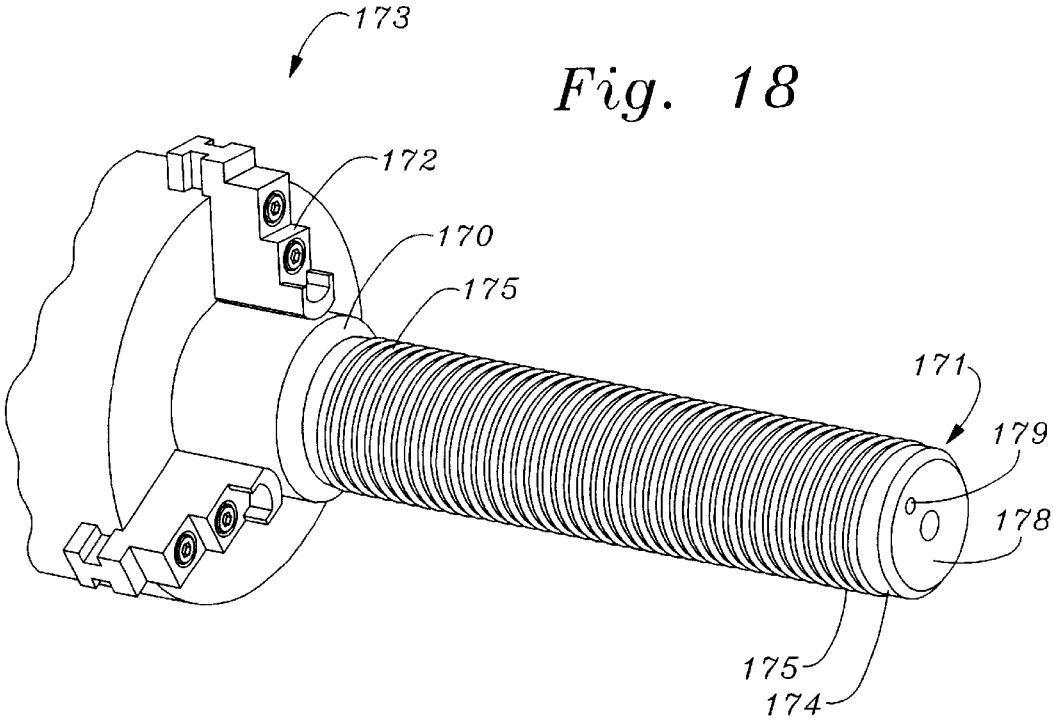
FIG. 18 is an elevation view of a coil winding mandrel clamped in the chuck of a winding lathe as a first step in manufacturing a frequency adjustable mobile antenna according to the present invention.

As shown in FIG. 18, a first step in manufacturing a coil assembly C comprises clamping a smooth, enlarged diameter cylindrical base section 170 of a longitudinally elongated cylindrical mandrel 171 in the chuck 172 of a winding lathe 173. Mandrel 171 has formed in the outer cylindrical wall surface 174 thereof a helical groove 175 of the same pitch but preferably of somewhat greater length than that of helical groove 125 in inner wall surface 117A of coil housing 117. As may be seen best by referring to FIG. 21, an outer longitudinal end of helical groove 175 terminates in a radially disposed bore 176 for receiving a free end 180 of a length of wire 177 to be wound into groove 175 of mandrel 171. Bore 176 is located proximate outer circular end face 178 of mandrel 171, and has a longitudinally disposed extension forming an exit bore 179 which penetrates end face 178.

Figure 19:
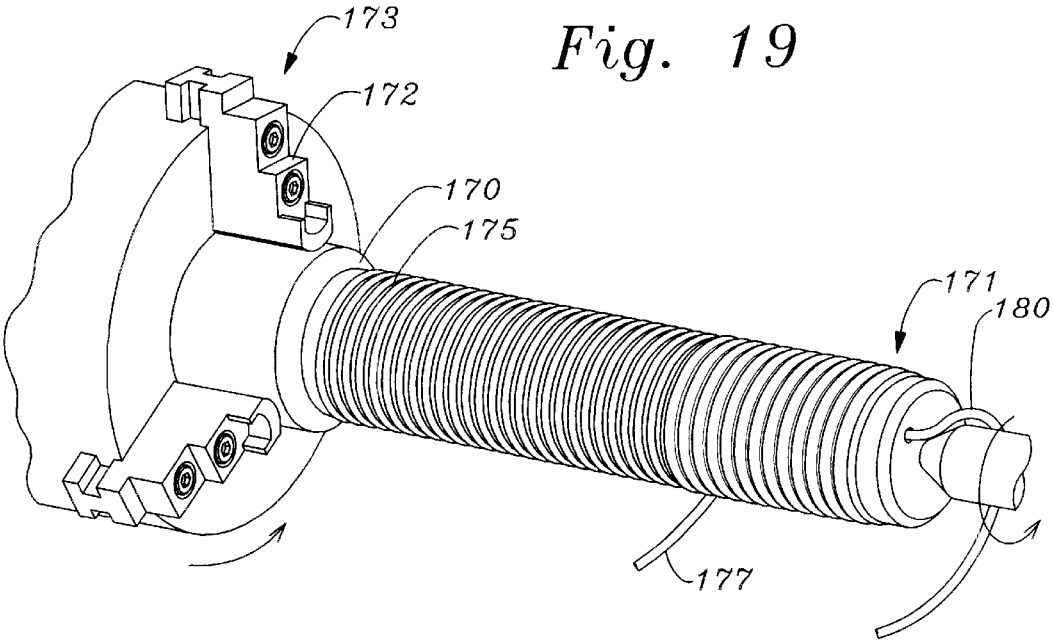
FIG. 19 is a view similar to that of FIG. 18 but showing a coil partially wound onto the mandrel.
Figure 20:
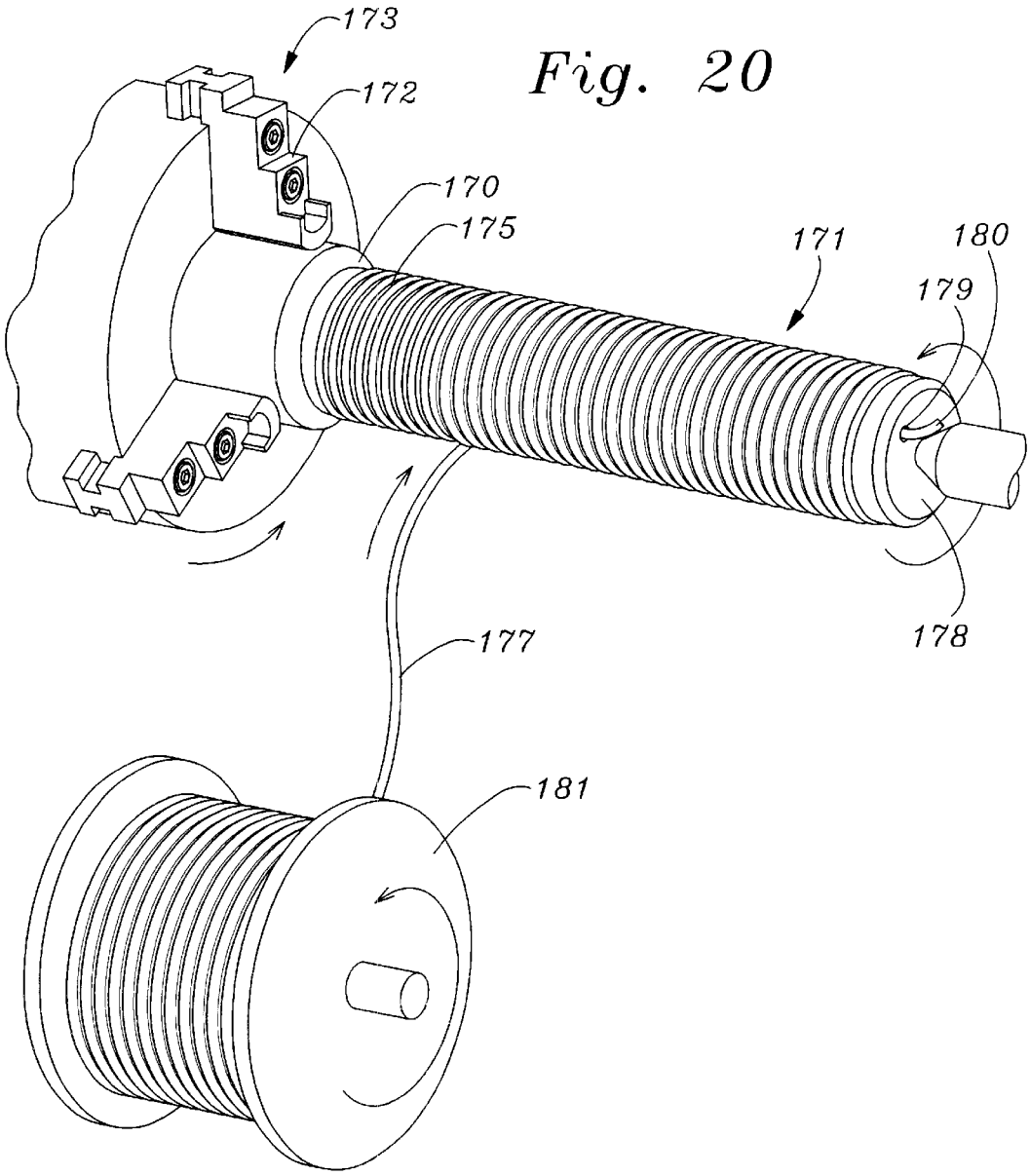
FIG. 20 is a view similar to that of FIG. 19, but showing the coil nearly completed.
Figure 21:
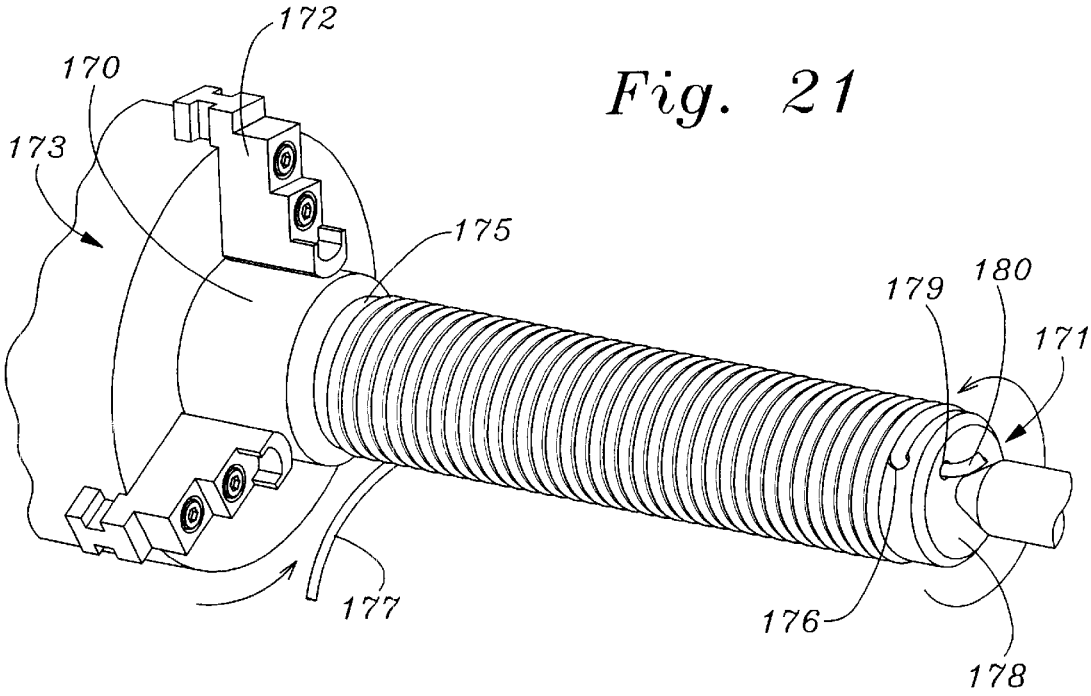
FIG. 21 is a view similar to that of FIG. 20, but showing the coil winding process completed.

FIGS. 19 and 20 illustrate a second step in the manufacture of a coil assembly C according to the method of the present invention. As shown in FIGS. 19 and 20, a free end 180 of a length of wire 177 which has been payed off a supply reel 181 is inserted through radially disposed bore 176 and out through longitudinally disposed exit bore 179 of mandrel 171, and whereupon the drive motor (not shown) of winding lathe 173 is energized to rotate the mandrel and thereby wind the wire to occupy a longitudinal fraction of helical groove 175 in the mandrel. FIG. 21 shows wire 177 wound to occupy a larger longitudinal fraction of groove 175 corresponding to the desired length of a finished coil 124.

Figure 22:
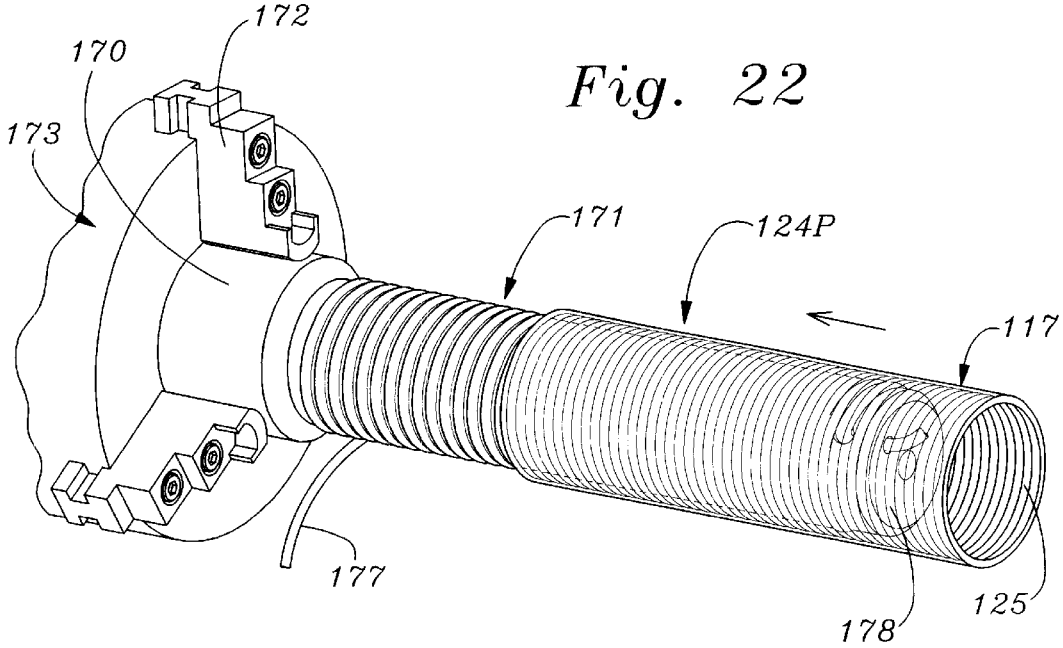
FIG. 22 is a view similar to that of FIG. 21, but showing a coil housing comprising part of the antenna being slipped over the completed coil.
Figure 23:
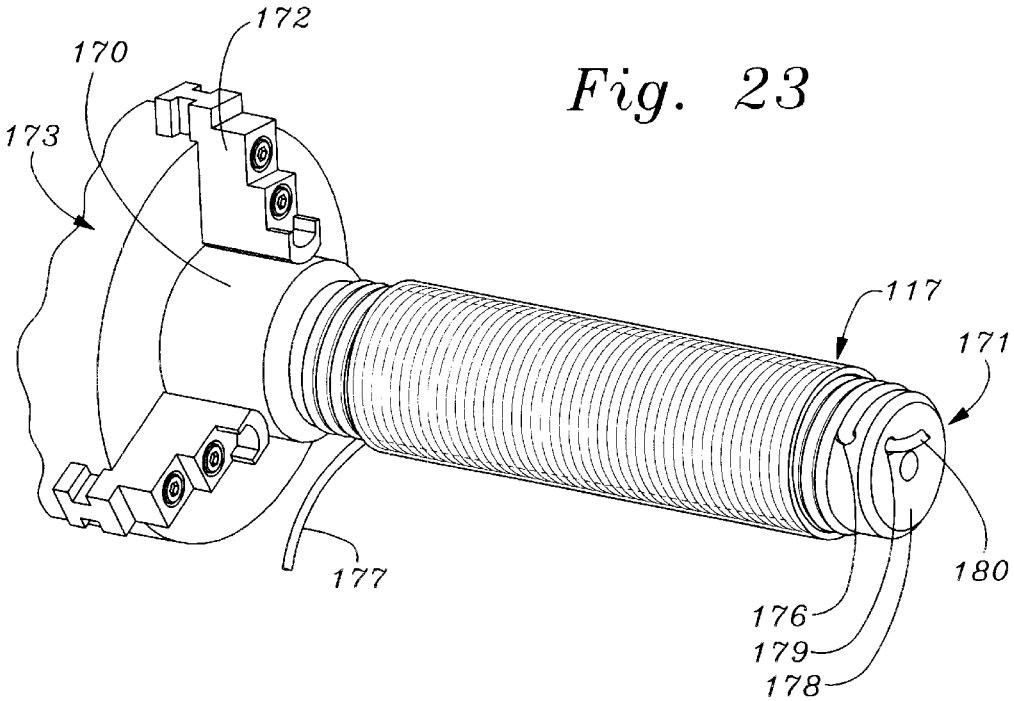
FIG. 23 is a view similar to that of FIG. 22, but showing the coil housing fully positioned over the completed coil.

FIG. 22 illustrates a third step in a method of making a coil assembly 169 according to the present invention. In that step, a coil housing 117 is slid longitudinally inwardly over outer end face 178 of mandrel 171, to coaxially overlie part of the fully wound, but partially finished coil 124P. FIG. 23 shows coil housing 117 pushed longitudinally inwards further to be fully underlain by coil 124P.

Figure 24:
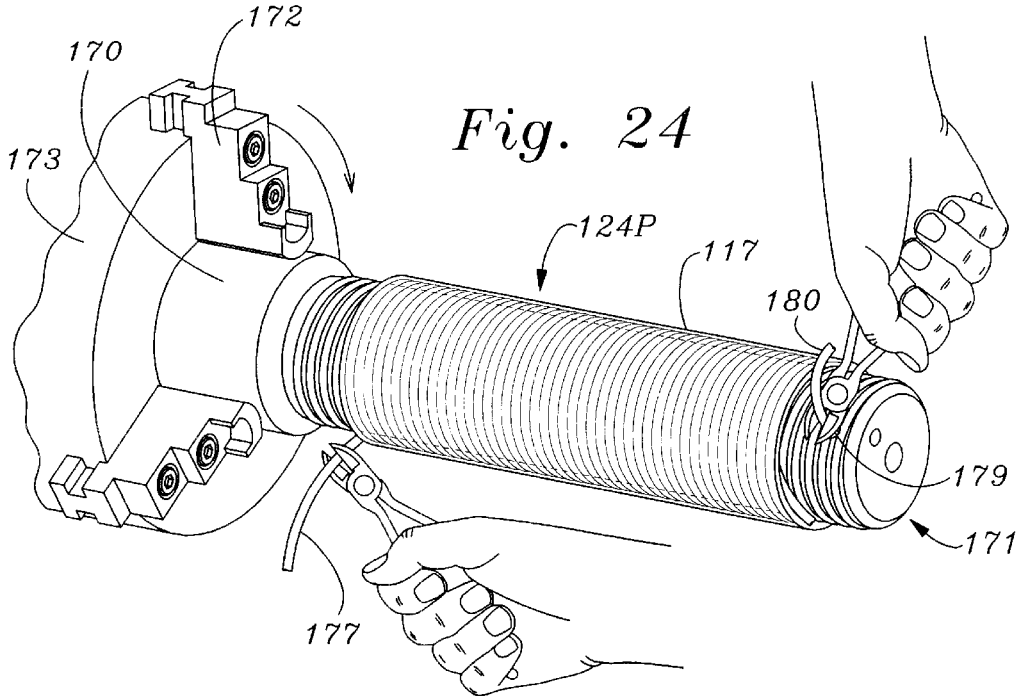
FIG. 24 is a view similar to that of FIG. 23, but showing a wire end connected to the wire supply reel at the inner end of the mandrel severed, and the mandrel rotated in a direction opposite to its winding direction, causing the coil convolutions to spring loosely into a helical groove provided in the inner wall of the coil housing.
Figure 25:
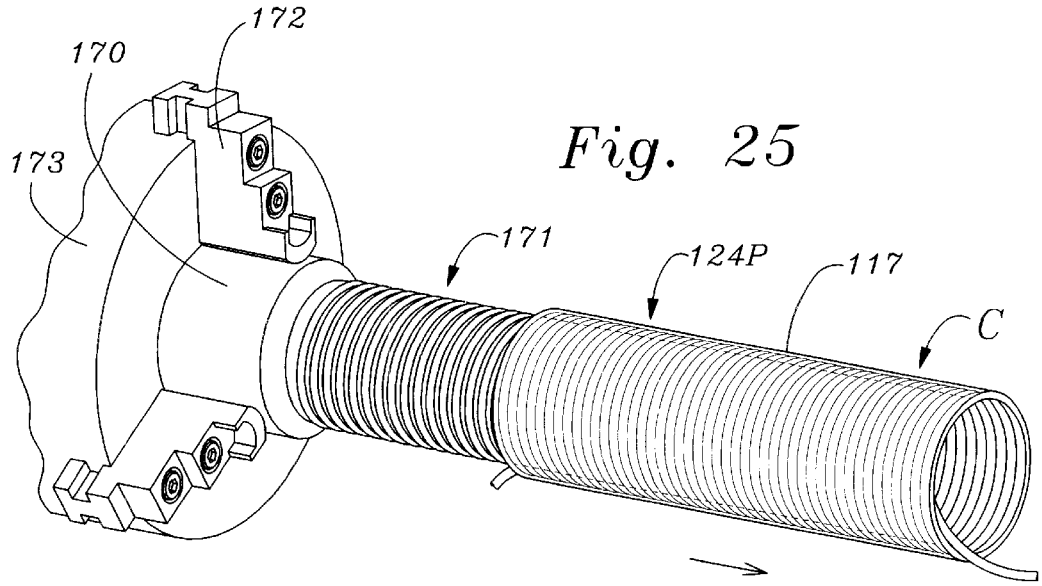
FIG. 25 is a view similar to that of FIG. 24, but showing the coil housing with the coil loosely engaged within the helical groove in the inner wall of the housing being removed from the mandrel.

As shown in FIG. 24, a fourth step in fabricating coil assembly C according to the present invention includes rotating lathe chuck 172 one or more turns in a direction opposite to the direction the chuck was turned in winding coil 124P onto mandrel 171. This action causes the diameter of coil 124P to enlarge, thus causing coil 124P to spring out of external helical groove 175 in mandrel 171, and into loose engagement within internal helical groove 125 in coil housing 117. Wire end 177 extending from supply reel 181 to the inner or lower end of coil 124P, and wire end 180 protruding from mandrel bore 179, are then both severed. As shown in FIG. 25, this expansion in the diameter of coil 124P out of mandrel groove 175 allows coil housing 117 containing coil 124P to be slid longitudinally off mandrel 171.

Figure 26:
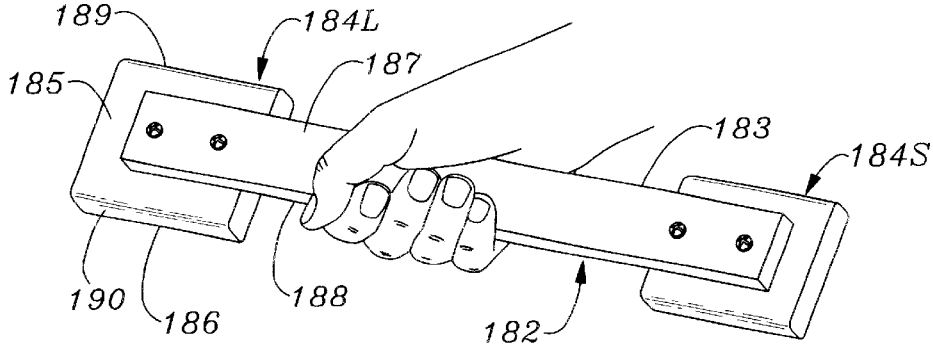
FIG. 26 is a perspective view of a coil tightening implement according to the present invention.

A fifth step in fabricating a finished coil assembly C according to the present invention comprises further expanding the diameter of coil preform 124P so that it fits tightly within helical groove 125 in coil housing 117. This step is preferably accomplished using a tightening implement and method which are both aspects of the present invention. Thus, as shown in FIG. 26, a tightening implement 182 according to the present invention includes a longitudinally elongated, rectangularly-shaped flat handle bar 183 fitted at one end with a resilient extension paddle 184. Paddle 184, which is preferably made of relatively hard, yet resilient material such as hard rubber, has the shape of a flat longitudinally elongated bar of greater width than handle bar 183 and is fastened with its larger, flat, longitudinally disposed parallel longitudinal upper and lower faces 185, 186 parallel to upper and lower faces 187, 188 of handle bar 183. Preferably, the elongated, thinner longitudinally disposed side walls 189, 190 of paddle 184 are convexly curved, having a radius approximating that of coil 124. As shown in FIG. 26, tightening implement 182 optionally includes different size paddles 184L and 184S at opposite ends of handle bar 183, for use with coils having different diameters.

Figure 28:
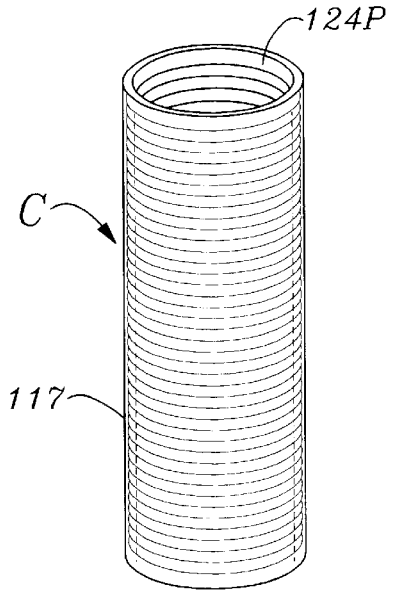
FIG. 28 is a perspective view of a completed coil assembly according to the present invention.
Figure 27:
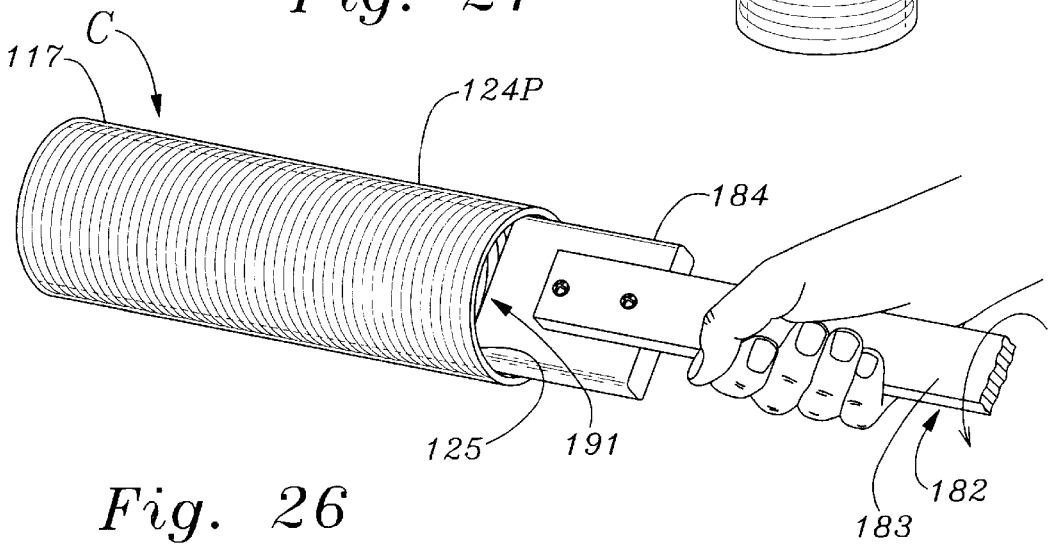
FIG. 27 is a perspective view showing an end of a coil tightening implement being inserted into a first end of the coil and housing of FIG. 25, the implement being rotated to firmly seat the coil convolutions in the helical groove of the coil housing.

As shown in FIG. 27, a sixth step in fabricating a finished coil assembly C according to the method of the present invention includes inserting paddle 184 of tightening implement 182 into bore 191 of a coil preform 124P, to a depth approximating half the length of the coil. Sides 189, 190 of paddle 184 are resiliently engaged with coil convolutions 124A during this step. Then, handle bar 183 is turned about its longitudinal axis in a direction opposite the original winding direction of coil 124P, causing coil convolutions 124A to be expanded in diameter to fit tightly with helical groove 125 in coil housing 117. Paddle 184 is then retracted from coil 124P, reinserted into the opposite longitudinal end of the coil, and the turning step repeated to fully seat the other longitudinally half portion of coil 124P into groove 125, thus making a completed coil assembly C as shown in FIG. 28. When coil 124P is wound from enameled wire, the inner cylindrical surface of convolutions 124A of coil preform 124P are then honed to remove insulation from wire 177, thus forming a complete coil assembly comprising a coil 124 securely seated with helical groove 125 of coil housing 117.

What is claimed is:

1. A frequency adjustable antenna for radio transceivers operable at different radio frequencies comprising;

a. a lower electrically conductive base mast section with a radio frequency connection thereto, b. an elongated hollow cylindrical housing made of an electrically non-conductive material and having formed in an inner cylindrical wall surface thereof a longitudinally disposed helical groove, c. an electrically conductive loading coil comprised of a conductor formed into spaced convolutions comprising a helix of the same pitch as said helical groove in said housing, and fitting within said groove with an inner cylindrical surface of said helix located radially inward of said inner cylindrical wall surface of said housing, d. a cap adapted to hold in electrical contact therewith an elongated conductive whip located at an upper end of said housing, said cap being in electrically conductive contact with an upper end of said coil, e. an elongated conductive shaft located coaxially within said mast and said coil, f. commutator means carried by and in electrically conductive contact with said conductive shaft for commutation with said spaced coil convolutions, g. RF de-coupler means in electrically conductive contact with a lower end of said coil, and in slidable electrical contact with said conductive shaft, and h. elevator means for raising and lowering said conductive shaft and said commutator means for selective commutation with said coil convolutions, thereby decreasing and increasing, respectively, the tuned frequency length of the combined coil and mast section.

2. The frequency adjustable antenna of claim 1 wherein said coil convolutions are coaxial with said commutator means for coil commutation.

3. The frequency adjustable antenna of claim 1 wherein said coil convolutions are coaxial with said cylindrical housing.

4. The frequency adjustable antenna of claim 3 wherein said cylindrical housing is coaxial with and projects upwardly from said mast section, and wherein said coil convolutions are coaxial with said commutator means for coil commutation.

5. The frequency adjustable antenna of claim 4 wherein said cap is coaxial with said housing.

6. The frequency adjustable antenna of claim 1 wherein said housing is carried by a base of electrically conductive material supported by said mast section.

7. The frequency adjustable antenna of claim 6 wherein said conductive shaft carrying said commutator means is guided coaxially with said mast section by a guide opening in said base.

8. The frequency adjustable antenna of claim 1 wherein said mast is tubular, and wherein said elevator means comprises in combination a reversible motor housed within a lower portion of said mast, a lead screw coupled to and protruding axially upward from a rotary output shaft of said motor, and an internally threaded base plug secured to said conductive shaft, said lead screw threadingly engaging said base plug.

9. The frequency adjustable antenna of claim 1 wherein commutator means is comprised of a disk having an electrically conductive periphery slidable within said convolutions of said loading coil.

10. The frequency adjustable antenna of claim 1 wherein said commutator means is comprised of a disk of electrically conductive material affixed to said conductive shaft, said disk having protruding radially outwardly thereof a circumferential spring member comprised of a pair of axially spaced apart circumferential supporting band members having disposed axially therebetween a plurality of circumferentially spaced apart, adjacent arched tabs resiliently biased radially outwardly to contact a substantial sector of at least one coil convolution.

11. The frequency adjustable antenna of claim 1 wherein said commutator means is comprised of a disk of electrically conductive material electrically conductively coupled to said conductive shaft, said disk having affixed thereto an electrically conductive circumferential spring member comprised of a single longitudinally elongated, rectangularly shaped strip of resilient conductive material, upper and lower longitudinal edges of which are bent rearwardly from a front, outer surface of said strip and thence axially inwardly towards a longitudinal center line of said strip to form two axially spaced apart, rear, inner longitudinally disposed supporting band members, the outer, front surface of said strip continuous with said supporting band members formed into an arcuately curved, convex arched surface segmented by a plurality of transversely disposed slits spaced apart at regular longitudinal intervals into a plurality of longitudinally spaced apart arched tabs, said strip being bent into a ring-shaped loop having an axially disposed curvature axis coaxial with said disk to thereby arrange said tabs into a circumferential array having convex outer surfaces resiliently biased radially outwardly to contact a substantial sector of at least one coil convolution.

12. The frequency adjustable antenna of claim 11 wherein said conductive material of said strip is further defined as being a beryllium copper alloy.

13. The frequency adjustable antenna of claim 1 wherein said RF de-coupler is further defined as comprising an annular ring-shaped body having protruding radially inwardly towards a central coaxial bore therethrough convex resiliently inwardly biased electrically conductive surfaces for electrically conductive contact with said conductive shaft longitudinally slidable through said central bore.

14. The frequency adjustable antenna of claim 1 wherein said RF de-coupler is further defined as an electrically conductive annular ring-shaped spring member comprised of a single longitudinally elongated rectangularly-shaped strip of resilient conductive material, upper opposed longitudinal edges of which are bent outwardly from the plane of the strip and thence axially inwardly towards a longitudinal center line of the strip to form two axially spaced apart rear, outer longitudinally disposed supporting band members, the inner, front surface of said strip continuous with said supporting band members being formed into an arcuately curved, convex arched surface segmented into a plurality of longitudinally spaced apart arched tabs, said strip being bent into a ring-shaped loop having an axially disposed curvature axis coaxial with said conductive shaft to thereby arrange said tabs into an annular ring-shaped array having convex inner surfaces resiliently biased radially inwardly to contact an outer cylindrical surface of said conductive shaft.

15. A method of making an electrically conductive tuning coil assembly for a frequency adjustable antenna, said coil comprised of an elongated hollow cylindrical housing made of an electrically non-conductive material and having formed in an inner cylindrical wall surface thereof a longitudinally disposed helical housing groove adapted to hold therein spaced convolutions of an electrical conductor formed into a helix of the same pitch as that of said helical housing groove, said method comprising the steps of;

a. winding a length of wire into a helical mandrel groove formed in the outer cylindrical surface of an elongated cylindrical mandrel of smaller diameter than that of said internally grooved housing, said mandrel groove having a pitch approximating that of said housing groove, said winding being effected by rotating said mandrel in a first sense with respect to a wire supply reel, b. inserting said mandrel into a hollow cylindrical space within said housing in coaxial alignment therewith, c. turning said mandrel in a second, opposite sense sufficiently far for said convolutions in said mandrel groove to increase in diameter and thereby spring radially outward of said helical mandrel groove and radially inward into said housing groove, d. severing said wire length between said supply reel and said mandrel, and e. removing said housing containing said coil convolutions from said mandrel.

16. The method of claim 15 further including the step of further increasing said diameter of said coil convolutions to firmly seat said convolutions within said housing groove.

17. The method of claim 16 wherein said further diameter increasing step is further defined as comprising inserting a resilient paddle into a first open end of said housing and into frictional engagement with inner circumferential surfaces of said coil convolutions, and turning said paddle about a longitudinal axis thereof in a sense opposite the winding sense of said coil convolutions.

18. The method of claim 17 including the further step of repeating the step of claim 17 at a second, open end of said housing.

19. The method of claim 15 wherein said winding step is further defined as temporarily anchoring a free end of said length of wire from said winding reel at a first longitudinal end of said mandrel.

20. The method of claim 19 wherein said free wire end anchoring step is further defined as comprising inserting said first free wire end into a bore provided in a cylindrical surface of said mandrel.

21. The method of claim 20 further including the step of removing said free wire end from said bore prior to removing said housing from said mandrel.

22. The method of claim 15 wherein said wire is further defined as having an insulating coating.

23. The method of claim 22 further including the step of honing an inner cylindrical surface of said coil convolutions to remove said insulating coating therefrom.

* * * * *